US012674315B2

(12) United States Patent
Klaassen et al.

(10) Patent No.: US 12,674,315 B2
(45) Date of Patent: Jul. 7, 2026

(54) STUD SYSTEM FOR CONNECTING FLANGES

(71) Applicant: Siemens Gamesa Renewable Energy A/S, Brande (DK)

(72) Inventors: Mark Klaassen, Voorburg (NL); Erwin de Jong, The Hague (NL)

(73) Assignee: SIEMENS GAMESA RENEWABLE ENERGY A/S, Brande (DK)

( * ) Notice: Subject to any disclaimer, the term of this patent is extended or adjusted under 35 U.S.C. 154(b) by 0 days.

(21) Appl. No.: 17/359,746

(22) Filed: Jun. 28, 2021

(65) Prior Publication Data

US 2022/0002990 A1 Jan. 6, 2022

(30) Foreign Application Priority Data

Jul. 1, 2020 (EP) ..... 20183436

(51) Int. Cl.
*E04B 1/38* (2006.01)
*E04H 12/08* (2006.01)
*E04H 12/34* (2006.01)

(52) U.S. Cl.
CPC ..... *E04B 1/388* (2023.08); *E04H 12/085* (2013.01); *E04H 12/342* (2013.01)

(58) Field of Classification Search
CPC ..... F16B 41/002; F16B 43/005; F16B 35/04; F16B 41/005; F16B 2200/506; E04B 1/40;

(Continued)

(56) References Cited

U.S. PATENT DOCUMENTS 1,409,904 A * 3/1922 Bayles ..... B25D 17/00 411/389
2,590,175 A * 3/1952 Hajdu ..... F16B 21/078 411/509

(Continued)

FOREIGN PATENT DOCUMENTS

CN 101749199 A 6/2010
CN 205654665 U 10/2016

(Continued)

OTHER PUBLICATIONS

European Search Report issued on Dec. 3, 2020 for application No. 20183436.3.

*Primary Examiner* — Phi D A
(74) *Attorney, Agent, or Firm* — Schmeiser, Olsen & Watts LLP

(57) ABSTRACT

Provided is a stud system for connecting a first flange to a second flange of a tower, the flanges including arrangements of openings in the first flange corresponding to arrangements of threaded blind openings in the second flange, with a predefined opening-length and a predefined opening-diameter of the openings in the first flange and a predefined non-threaded length and a predefined threaded length of the threaded blind openings in the second flange, the stud system including: a stud bolt with a head end, a threaded end and an intermediate portion, and a spacer tube partly encompassing the stud bolt with an outer diameter bigger than the predefined opening-diameter, wherein the stud bolt includes stopping means at the head end, preventing the spacer tube from slipping over the head end. The spacer tube) constructed such that it can be removed laterally from the stud bolt.

7 Claims, 6 Drawing Sheets

(58) Field of Classification Search
CPC ..... E04H 12/085; E04H 12/342; Y02E 10/72; Y02E 10/728
See application file for complete search history.

(56) References Cited

U.S. PATENT DOCUMENTS 2,933,970 A * 4/1960 Pagano ..... F16B 21/186 411/517
3,138,188 A * 6/1964 Tuozzo ..... F16B 41/002 220/570
3,156,281 A * 11/1964 Demi ..... F16B 39/24 403/243
3,412,774 A * 11/1968 Schuster ..... F16B 41/002 411/353
3,474,847 A * 10/1969 Bedford, Jr. ..... F16B 41/002 411/352
3,561,075 A * 2/1971 Selinko ..... F16B 5/065 24/694
3,741,594 A * 6/1973 Ostling ..... F16B 12/26 403/349
3,779,585 A * 12/1973 Handzlik ..... F16L 3/00 285/136.1
4,449,855 A * 5/1984 Langwadt ..... E02D 5/76 52/223.13
5,244,325 A * 9/1993 Knohl ..... F16B 41/002 411/970
5,316,259 A * 5/1994 Pawlykowych ..... B62J 1/06 267/132
5,412,972 A * 5/1995 Congelliere ..... B21D 53/20 72/340
5,511,909 A * 4/1996 Calandra, Jr. ..... E21D 21/0046 405/259.1
5,642,972 A * 7/1997 Ellis ..... F16B 41/002 411/352
5,662,444 A * 9/1997 Schmidt, Jr. ..... F16B 41/002 411/533
5,807,052 A * 9/1998 Van Boven ..... F02F 1/24 411/537
6,116,837 A * 9/2000 Suhle ..... F16B 21/088 411/526
6,227,784 B1 * 5/2001 Antoine ..... F16F 1/3732 411/353
6,280,132 B1 * 8/2001 Szczukowski ..... F16B 41/002 411/107
6,309,156 B1 * 10/2001 Schneider ..... F16B 41/002 411/107
6,582,171 B2 * 6/2003 Bondarowicz ..... F16B 21/18 411/525
6,688,826 B2 * 2/2004 Agha ..... F16B 43/00 411/352
6,769,851 B2 * 8/2004 Agha ..... F16B 43/00 411/161
6,997,658 B2 * 2/2006 Fly ..... F16B 19/02 411/549
7,815,408 B2 * 10/2010 Sessa ..... F16B 5/02 411/301
7,905,695 B2 * 3/2011 O Brien ..... F16B 39/26 411/149
8,950,992 B1 * 2/2015 Vayntraub ..... F16B 13/04 411/344
9,062,701 B2 * 6/2015 Hyatt ..... F16B 35/048
9,790,974 B2 * 10/2017 Holt ..... F16B 21/02
10,228,012 B2 * 3/2019 Holt ..... F16B 41/002
10,823,222 B2 * 11/2020 Hübner ..... F16B 5/0258
11,204,059 B2 * 12/2021 Becker ..... F16B 41/002
11,898,608 B2 * 2/2024 Itta ..... F16D 7/021
2010/0126079 A1 5/2010 Kristensen
2013/0004264 A1 1/2013 Bernard et al.
2014/0356093 A1 * 12/2014 Nitschmann ..... F16B 12/20 411/55
2014/0360123 A1 * 12/2014 Dicaire ..... F16B 5/02 411/403
2015/0096665 A1 * 4/2015 Jackson ..... F16B 39/108 411/106
2019/0292909 A1 * 9/2019 Mirabile ..... E21D 21/0086
2019/0293108 A1 * 9/2019 Sandwall ..... F16B 41/002
2021/0205589 A1 * 7/2021 Dong ..... A61M 27/002

FOREIGN PATENT DOCUMENTS

CN 205714591 U * 11/2016 ..... F16B 43/005
CN 106801695 A 6/2017
EP 2006471 A1 12/2008
EP 177296 B1 * 6/2011 ..... F16B 43/005
EP 2511424 A1 * 10/2012 ..... E02B 17/00
EP 2775137 A2 * 9/2014 ..... F03D 7/0224
EP 2884027 A1 * 6/2015 ..... E02D 27/42
GB 2505468 A * 3/2014 ..... F28D 7/005
GB 2591884 A * 8/2021 ..... F16B 43/005
NL 1004960 C1 7/1998
WO WO 2018095497 A1 5/2018

* cited by examiner

STUD SYSTEM FOR CONNECTING FLANGES

CROSS-REFERENCE TO RELATED APPLICATIONS

This application claims priority to European Application No. 20183436.3, having a filing date of Jul. 1, 2020, the entire contents of which are hereby incorporated by reference.

FIELD OF TECHNOLOGY

The following describes a stud system for connecting flanges, a flange with such stud system, a method of assembling a tower, e.g., a wind turbine tower and such tower.

BACKGROUND

Tall towers such as wind turbine towers are generally constructed by connecting tower sections together. To this end, each tower section is equipped with flanges. A common flange shape is the "L-flange", and complementary L-flanges are connected together by fasteners such as bolts arranged in a bolt circle.

Large wind turbines of the types currently in development have very long rotor blades and therefore require taller towers. However, the limited load-bearing capacity of the commonly used L-flange connection places constraints on the tower structure.

To provide a better flange connection, lately so-called X-flanges are used. The key feature of these new flanges is the ability to transfer much higher loads compared to conventional (L-) flanges, mentioned above. First ideas of an 'X-flange' are e.g., described in patent NL C 1004960. X-flanges are often combined with the L-shape, resulting in an 'XL-flange', i.e. a flange with an L-circle of apertures (often an inner circle) and a region of X-shaped apertures. Thus, the XL-flange is special a variant of the X-flange.

The flanges are connected with each other by studs that are screwed into threaded blind holes during installation. Concerning the X-flanges, a plurality of studs have to be inserted and fastened. Especially when the connection is made offshore, the required time should be kept as low as possible to reduce required time for the installation vessel.

SUMMARY

An aspect relates to an improved flange connection that overcomes the problems described above and to enable a fast and secure connection of flanges.

In the following, for the sake of simplicity but without restricting the invention in any way, it may be assumed that the invention pertains to studs made for connecting flanges of tower sections, for example a wind turbine tower section. With the term "stud" also a bolt or a screw is meant, generally any longitudinal fastener with a thread that is able to connect flanges with blind openings. A tower section may also be referred to as a "tower shell".

An embodiment of the inventive flange is "part of" the tower section at the time when the tower sections are being connected. This shall be understood to mean that a tower section and its flange may be regarded as a single entity, e.g., formed as a single body. Equally, the tower section and its flange may be manufactured separately and then joined, for example a flange may be welded to a steel tower shell, or the upright cylindrical portion of a flange may be embedded in an outer end of a concrete tower shell.

The flange comprises a bolt circle, wherein especially the invention is advantageous for X-flanges with a respective bolt circle with inclined openings. The inclined openings of the X-flange extend from the flange connection face into the body of the flange. One advantageous strategy is to have the studs pre-installed on the top flange, thus, reducing construction time while assembling the tower, since the studs do not have to be inserted on-site.

A stud system according to the invention is designed for connecting a first flange to a second flange of a tower, especially a wind turbine tower. The flanges, especially X-flanges, comprise annular arrangements of openings in the first flange corresponding to annular arrangements of threaded blind openings in the second flange, with a predefined opening-length and a predefined opening-diameter of the openings in the first flange and a predefined non-threaded length and a predefined threaded length of the threaded blind openings in the second flange.

The stud system comprises the following components:

A stud bolt with a head end, a threaded end and an intermediate portion between the head end and the threaded end. The stud bolt is a stud (the term "stud bolt" is used to not confuse it with the "stud system"). The threaded end is preferably the threaded portion of the stud bolt that is intended to be screwed into the thread of a threaded blind opening of a flange. The head end is especially the portion of the stud bolt emerging from the opening of the flange when the stud bolt is screwed into the thread of the blind opening. The intermediate portion is the portion between. It can be a shank or threaded or partly both.

A spacer tube partly encompassing the stud bolt with an outer diameter bigger than the predefined opening-diameter. The big outer diameter of the spacer tube prevents the stud bolt to slip into an opening of the flange as long as the spacer tube is connected with the stud bolt.

The stud bolt comprises stopping means at the head end, e.g., a nut, preventing the spacer tube from slipping over the head end. Furthermore, the spacer tube is constructed such that it can be removed laterally from the stud bolt.

This has the advantage that a stud bolt can be arranged in a hole of a flange with its threaded end (and possibly with a part of the intermediate portion), but does not completely slip into the opening (due to the dimensions of the spacer tube and since the spacer tube cannot slip from the head end). By removing the spacer tube laterally from the stud bolt, the stud bolt slips into the opening (advantageously especially after flanges have been arranged over another) and can be used to connect two flanges. Thus, a flange pre-equipped with stud systems in its openings can be arranged over another flange, the spacer tubes can be removed and the stud bolts fall into fastening positions. This accelerates the manufacturing of a tower.

It should be noted that the flange itself is not part of the stud system, however, the dimensions of the flange are known and a stud system is designed to fit for an individual group of flanges with similar dimensions. This means that the general setup of the stud system always stays the same, but its dimensions, especially the length and diameter of its stud bolt and the length and diameter of the spacer tube depends on the application, i.e. the dimensions of the flange the stud system should be applied.

For an easy arrangement of two flanges it is preferred that the spacer tubes are dimensioned such that the threaded ends do not stick out at the bottom of a pre-equipped flange, i.e. the flange contact surface, (or just for a small portion).

However, also a setup where the threaded ends are sticking out through the bottom surface of a flange (e.g., after lifting a tower section connected with this flange) may be advantageous.

A flange according to the invention comprises an annular arrangement of openings, especially inclined openings (since the invention is especially advantageous for X-flanges), wherein the flange is especially welded to a tower section. the flange comprises a plurality of stud systems according to the invention that are arranged in the openings. Thus, the stud systems are pre-installed in the flange as mentioned above. In an embodiment, the spacer tubes of a plurality of stud systems are connected with each other with a connection element as further described below, to easily and quickly remove the spacer tubes.

A method according to the invention is advantageous for assembling a tower, especially a wind turbine tower. This tower comprising tower sections, essentially each equipped with a flange, especially a flange according to the invention (at least flanges intended to be the upper flanges), on each face. The flanges comprise annular arrangements of threaded blind openings. The method comprises the following steps:

Arranging a tower section on top of a further tower section so that annular arrangements of openings of the flanges accord to each other to receive a set of fasteners for connecting the flanges. Thus, tower sections comprising corresponding flanges at their ends are put upon another so that the flanges and their corresponding openings meet and fit.

Arranging a number of stud systems according to the invention in a corresponding number of openings of the flanges from above prior or after the arrangement of the tower segments. This may result in a flange pre-equipped with stud systems. Although it is possible to install only one stud system it is preferred that "number" refers to a plurality of stud systems, e.g., covering essentially all through openings of a flange.

Removing of a number of spacer tubes from the stud bolt of at least one arranged stud system so that the stud bolt is able to fall in the corresponding opening. The stud bolts can be removed separately or together, e.g., wherein the spacer tubes are connected by a rope and the rope is torn. It is clear that the flange with the stud system should be positioned such that the studs can fall down in the openings for the flange by gravity.

Forming a permanent connection between the tower section and the further tower section by the stud bolts. This is e.g., achieved by screwing the threaded end of the stud bolts into the threads of the threaded blind openings and possibly screwing the nut on the head end until the flanges are fastened together. The connection is "permanent" in the sense that it may endure for the lifetime of the structure.

A tower according to the invention, especially a wind turbine tower, comprising a plurality of essentially cylindrical tower sections equipped with flanges and permanently connected by stud bolts inserted through the inclined openings of the flanges by a method according to the invention. Due to the safer handling of the threads of the bolts and the flanges, especially due to the possibility to provide pre-equipped flanges, the risk of damaging surfaces and threads is seriously reduced. This does not only mean that the construction of the tower is faster and cheaper (no need to repair damaged threads), but also that the tower is less affected by environmental conditions, since protective layers on the flange or in the blind holes or around the stud bolts are not damaged. Thus, due to the invention, the inner corrosion of flanges or the corrosion of stud bolts is seriously reduced resulting in an improvement of the stability of the whole tower.

Particularly advantageous embodiments and features of the invention are given by the dependent claims, as revealed in the following description. Features of different claim categories may be combined as appropriate to give further embodiments not described herein.

According to a preferred stud system, the head end is threaded and the stud bolt comprises a nut on the threaded head end as stopping means. Thus nut can also be used for fastening the connection between two flanges after the stud bolt is screwed into the threaded blind opening of a flange. The stopping means could also be a bolt head.

In an embodiment, the stud bolt also comprises a washer, and/or a bolt extender or an extender-washer representing a combination of washer and a bolt extender, each component is arranged around the stud bolt. A washer is preferably arranged between nut and spacer tube. A bolt extender or an extender washer is preferably arranged around the stud bolt at the far side of the spacer tube seen from the nut. For practical reasons it is easier to keep the bolt extender or the extender-washer at the bottom, since there it could absorb the possible impact of the nut dropping down during installation.

As said above, when the spacer tubes are pulled laterally, the stud bolts will fall down in the openings of a flange. However, this comes with a risk of the threaded end of the stud bolt damaging itself or the thread of the blind hole upon dropping due to the impact of stud head hitting the thread. When hitting the thread, not only a protective layer or surface may be damaged, but also the thread of the opening or the stud bolt may be deformed. The problem of damaging the internal threads of X-flanges due to dropping bolts into the respective holes arose especially after developing the X-flange.

According to a preferred stud system, the nut is arranged such that a remaining connecting-length between the nut, or especially the washer, and the tip of the threaded end is shorter than the predefined opening-length plus the predefined non-threaded length. It is further preferred that the thread of the head end is designed such that the nut can be turned in order to increase the connecting length.

According to a preferred method, a number of stud systems with the special positioning of the nut described before are arranged in a corresponding number of openings of a flange (especially the upper flange), comprising the additional step of after removing of the number of spacer tubes: increasing the connecting length of the stud bolt by turning the nut along the threaded part of the head end until the connecting length is longer than the predefined opening-length plus the predefined non-threaded length.

Thus, when the stud bolt falls down, the fallen stud bolt does not touch the thread of the threaded blind opening, i.e. the remaining connecting length of a stud bolt from the nut to the tip is shorter than the predefined opening length plus the predefined non-threaded length. Thus, when removing the spacer tube, the stud bolt will fall in the opening until the tip of its threaded end stops in a position before the thread of the threaded blind opening. Then the nut can be moved upwards the head end causing the stud bolt to smoothly touch the thread. After that, the stud bolt may be screwed into the thread and the flanges are fastened by fastening the nut.

According to a preferred stud system, the spacer tube is formed by at least two spacer segments, a first spacer segment and a second spacer segment, arranged adjacent to another. Thus, the two spacer segments are stringed on the stud bolt and can be individually removed. It is preferred that the first spacer segment and the second spacer segment are movably connected with each other, preferably such that after removing the first spacer segment the removed first spacer segment still clings to the second spacer segment. This will reduce the effort to collect removed spacer tubes after construction. It is further preferred that the connection is achieved by connection loops, especially made of wire or string.

According to a preferred method applicable for such segmented spacer tubes, a number of stud systems comprising such segmented spacer tubes are arranged in a corresponding number of openings of a flange. The method comprises the additional step of after removing a first spacer segment from a stud bolt and falling of the stud bolt in the corresponding opening: removing a second spacer segment from the stud bolt to bring the stud bolt in connection with a thread of the opening. It is preferred that the length of the first spacer element is chosen such that the fallen stud bolt does not touch the thread of the threaded blind opening, i.e. the remaining connecting length of a stud bolt comprising only the second spacer element at the stopping means is shorter than the predefined opening length plus the predefined non-threaded length. Thus, when removing the first spacer segment, the stud bolt will fall in the opening until a position before the thread of the threaded blind opening. Then the second spacer segment can be removed causing the stud bolt to touch the thread with a much lower impact. After that, the stud bolt may be screwed into the thread.

It is further preferred, when the first spacer segment and the second spacer segment are movably connected with each other, to perform the removing procedure of the first spacer segment such that the removed first spacer segment still clings to the non-removed second spacer segment.

The advantage of the above embodiments is the protection of the internal flange threads while dropping the stud bolts into their respective bolt holes.

According to a preferred stud system, the length of the spacer tube is such that when arranged at the stopping means the remaining length of the intermediate portion that is not covered by the spacer tube together with the length of the threaded end is shorter than the predefined opening-length. Thus, stud systems pre-installed on a respective flange do not protrude from the bottom of the flange so that the arrangement on a corresponding flange is easier.

According to a preferred stud system, the spacer tube is made from metal, cardboard, wood or a (dense) polymer, especially polyethylene or polyprophylene.

The spacer tube may have arbitrary longitudinal shapes, especially prism-shapes, such as a hexagonal or square tube. According to a preferred stud system, the spacer tube has a cylindrical shape.

It is further preferred that a part of the circumference is removed, creating an open C-section. It is preferred that the width of the opening is less than a diameter of the intermediate portion of the stud bolt so that the spacer tube does not fall from the stud bolt itself, but can be removed by pulling it sideways from the stud bolt, wherein the width of the opening is preferably bigger than 90% of the diameter of the intermediate portion. This shape is advantageous for laterally removing the spacer tube from the stud bolt.

According to a preferred method, the openings of the flanges are inclined relative to the vertical direction, especially by at least 5°, preferably by at least more than 10°, but especially less than 45°, and wherein a number of stud systems is arranged in a corresponding number of the inclined openings of the flanges from above.

According to an embodiment of the invention, the spacer tube of a stud system comprises a connection loop, e.g., a filament loop, a bail, a lug or a hook. Although it is generally preferred that the loops are closed, it can be also preferred depending on the application that the loops are open (hooks). Depending on the application, it is preferred that the loops are deformable, e.g., made of string, wire or steel cable, or rigid, especially as a part of the structure of the spacer tube (such as a pot handle).

Using a plurality of such stud systems, the connection loops can advantageously be connected with each other by a connection element. It is preferred (in the course of the construction method) that the spacer tubes are removed by moving, especially by pulling, the connection element such that the spacer tubes are laterally removed from the respective stud bolts. The connection element is preferably elongated and flexible and is particularly preferably a rope or a chain.

Although it is preferred that the connection element is lead through the connection loops, it is also preferred, depending on the application, that the connection element is otherwise fastened to the spacer tubes, e.g., by gluing or casting it into the material of the spacer tubes so that the spacer tubes have a defined distance. It is also possible that the connection element is a (thin) tape that is clamped between the surface of the stud bolts and the inner surface of the spacer tubes, e.g., entering and exiting through a longitudinal slit of the spacer tube. By pulling and straightening the tape, the spacer tube will be removed laterally from the stud bolt.

BRIEF DESCRIPTION

Some of the embodiments will be described in detail, with references to the following Figures, wherein like designations denote like members, wherein.

DETAILED DESCRIPTION

Figure 1:
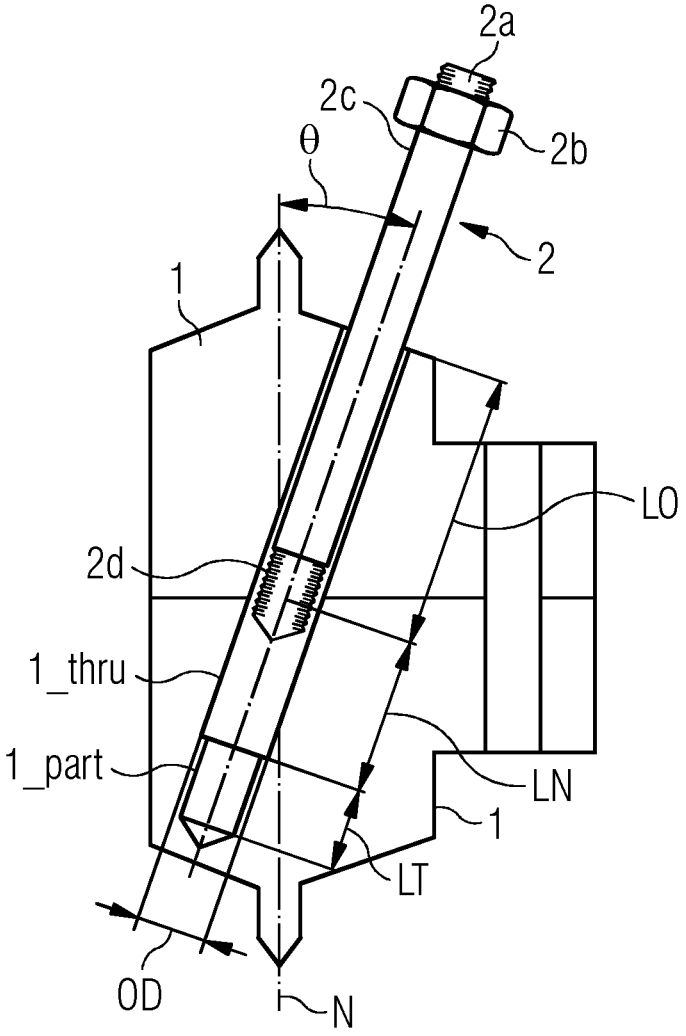
FIG 1 PRIOR ART
FIG. 1 shows a cross section of a flange connection with a stud bolt according to the prior art.

FIG. 1 shows a cross section of a flange connection with a stud bolt 2 according to the prior art. Each flange has a primary bolt circle comprising an annular arrangement of inclined openings 1_thru, 1_part to receive a set of fasteners (the stud bolts 2) for connecting the flange 1 to the complementary flange 1. An inclined opening 1_thru, 1_part of the primary bolt circle is characterized by the angle of inclination θ subtended between its longitudinal axis (dash dotted line) and a surface normal N of the flange connection face. The flange 1 also comprises a body section (L-part) with a secondary bolt circle comprising an annular arrangement of openings (vertical hole at the right side of the flange) to receive a set of fasteners for connecting the flange 1 to an interim structure or to the complementary flange 1.

The stud bolt 2 can theoretically be divided into three parts: the head end 2*a,* that is threaded here and provided with a nut 2*b,* the threaded end 2*d,* with which the stud bolt 2 is screwed into the thread of the threaded blind opening 1_part, and an intermediate portion 2*c* that may be (partly) threaded or (partly) a shank. The length of the hole in the upper flange segment is predefined and the predefined "opening-length" LO. The length of the non-threaded part of the blind opening 1_part in the lower flange 1 is the predefined non-threaded length LN, and the length of the threaded part of the blind opening 1_part in the lower flange 1 is the predefined threaded length LT. Both openings 1_thru, 1_part have a predefined opening diameter OD at least concerning the non-threaded part.

Figure 2:
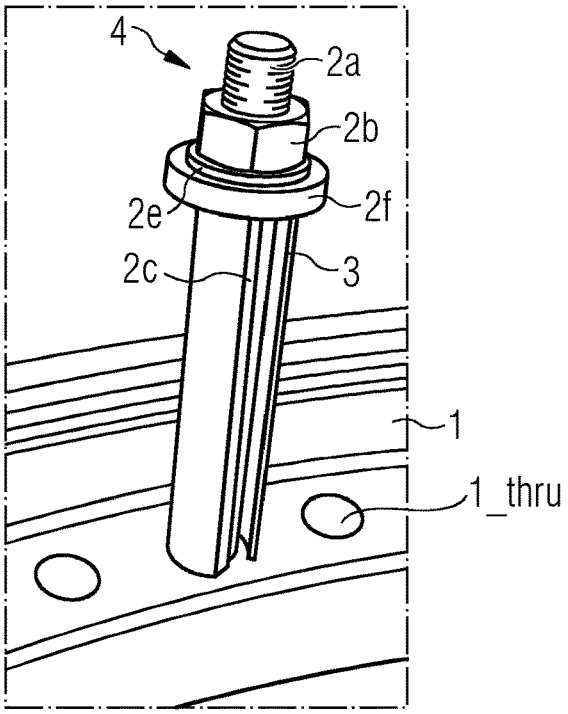
FIG. 2 shows a perspective view on a preferred stud system according to embodiments of the invention.

FIG. 2 shows a perspective view on a preferred stud system 4 according to embodiments of the invention. It comprises a stud bolt 2 like shown in FIG. 1 and a spacer tube 3. In difference to the stud bolt 2 of FIG. 1, the preferred stud bolt 2 shown here additionally comprises a washer 2*e* and an bolt extender 2*f.*

The stud system is arranged in an opening 1_thru of a flange 1. This is possible because of the spacer tube 3 that prevents the stud bolt 2 from falling into the opening 1_thru, but only sticking in it with a fraction of its length (see e.g., FIG. 4). The spacer tube 3 partly encompasses the stud bolt 2 with an outer diameter bigger than the predefined opening-diameter OD (see FIG. 1) and is prevented from slipping over the head end 2*a* of the stud bolt 2 by the nut 2*b* acting as stopping means 2*b*. The spacer tube 3 is constructed such that it can be removed laterally from the stud bolt 2 due to a slit that can be seen over the whole length of the spacer tube 3.

Figure 3:
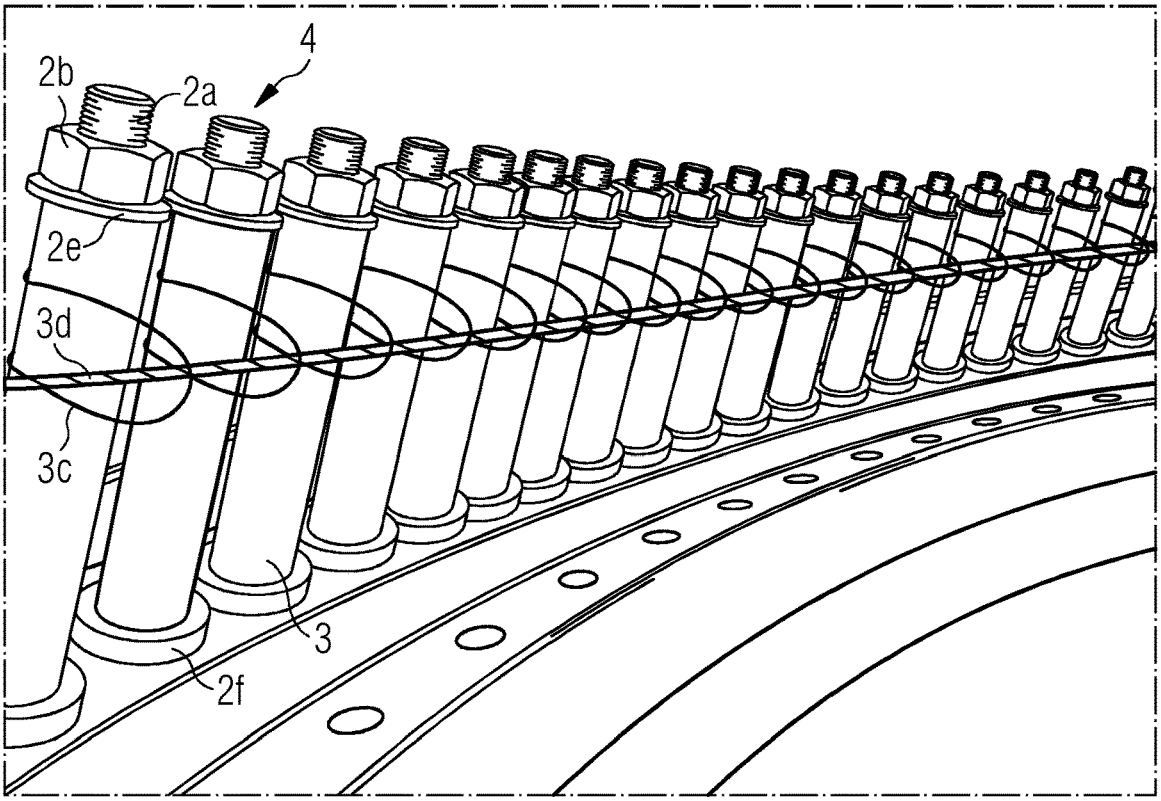
FIG. 3 shows a perspective view on a flange equipped with stud systems according to the invention.

FIG. 3 shows a perspective view on a flange 1 equipped with stud systems 4 according to embodiments of the invention. The stud systems are mainly the same as shown in FIG. 2 with the differences that the bolt extender 2*f* is arranged between flange 1 and spacer tube 3 and that the spacer tubes comprise filament loops 3*c* as connection loops 3*c,* wherein the filament loops 3*c* of all spacer tubes 3 are connected with each other by a rope serving as connection element 2*d*. By pulling this rope, the spacer tubes 3 could be quickly removed from the stud bolts 2 of the stud system 4.

Figure 4:
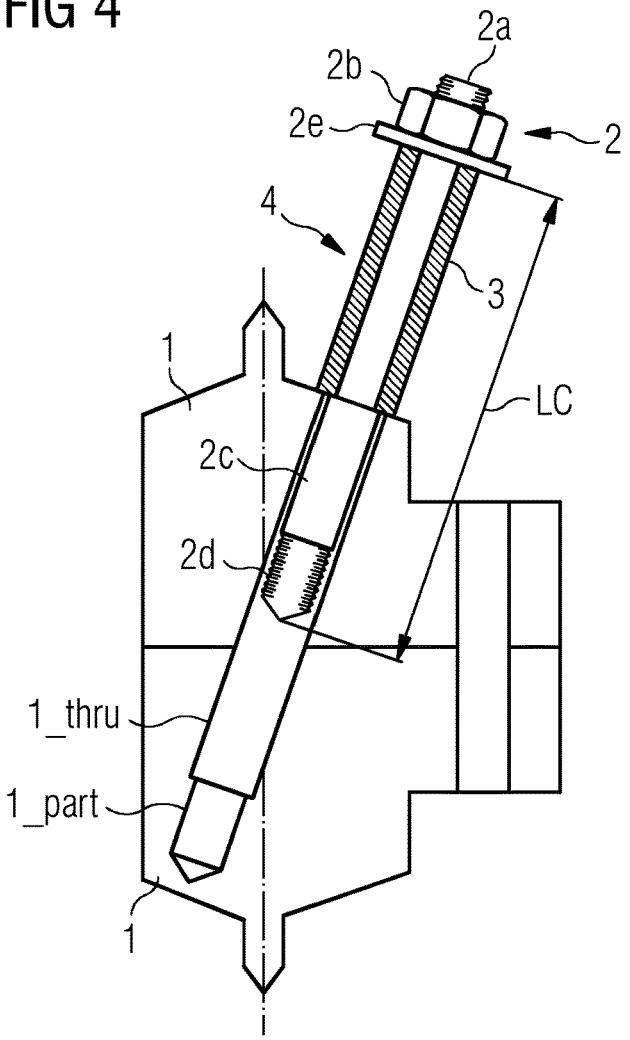
FIG. 4 shows a cross section of a flange connection with a preferred stud system according to the invention.

FIG. 4 shows a cross section of a flange connection with a preferred stud system 4 according to embodiments of the invention, similar to the stud system 4 shown in FIG. 2 (only without a bolt extender 2*f*). It can be seen that the spacer tube 3 prevents the tip of the stud bolt 2 from protruding out of the bottom of the flange 1. The distance between the washer 2*e* and the tip of the threaded end 2*d* is the connecting-length LC. This is the length with that the stud bolt would extend into the opening 1_thru, 1_part if there were no spacer tube 3.

Figure 5:
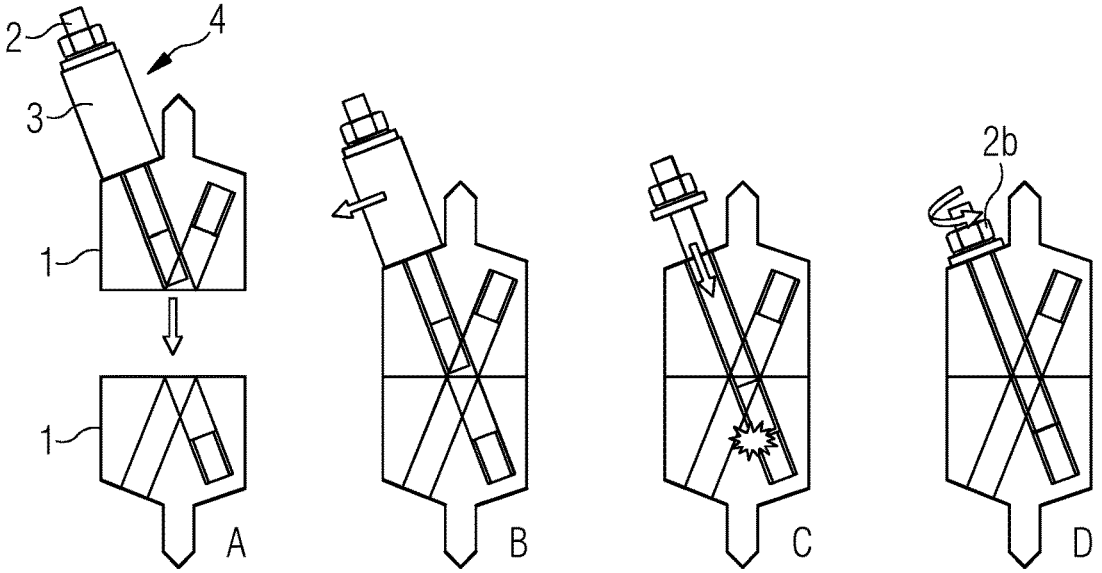
FIG. 5 shows the procedure of forming a flange connection with a stud system according to FIG. 4.

FIG. 5 shows the procedure of forming a flange connection with a stud system 4 according to FIG. 4.

In the left picture A, the flanges 1 are arranged upon another. Since the stud system 4 does not protrude from the bottom of the upper flange, an easy adjustment is possible.

In the next picture B, the spacer tube 3 is removed and the stud bolt glides down in the opening 1_thru, 1_part of the flange.

In the next picture C, the threaded end 2*d* of the stud bolt 2 hits the thread of the blind opening 1_part.

Now, in picture D, the stud bolt 2 can be screwed into the thread and the nut 2*b* can be fastened to connect the flanges 1 with each other.

Figure 6:
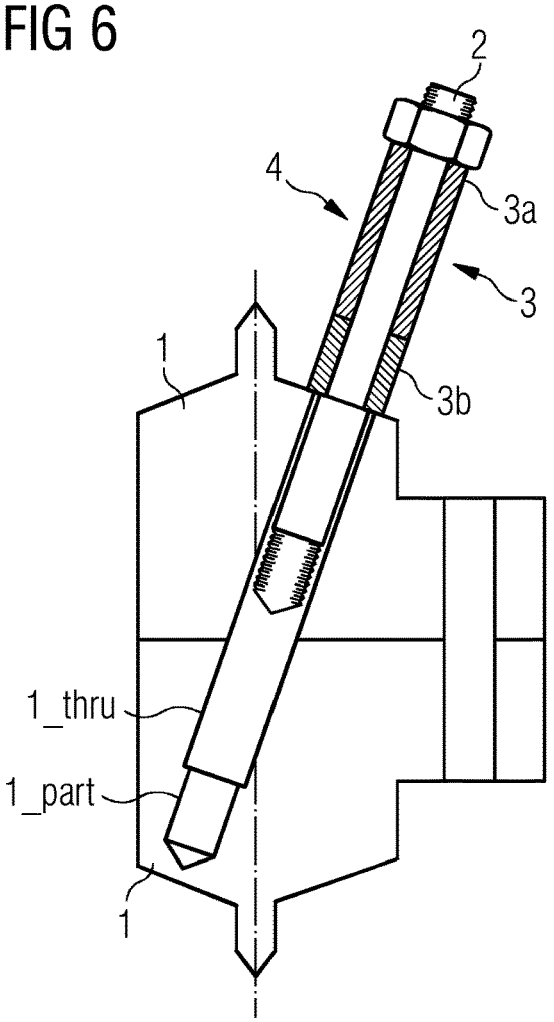
FIG. 6 shows a cross section of a flange connection with a preferred stud system according to the invention.

FIG. 6 shows a cross section of a flange connection with a stud system 4 according to embodiments of the invention. This stud system 4 is similar to the stud system shown in FIG. 4 with the difference that the spacer tube 3 is segmented into a first spacer segment 3*a* and a second spacer segment 3*b*. These two spacer segments 3*a,* 3*b* can be removed separately from the stud bolt 2.

Figure 7:
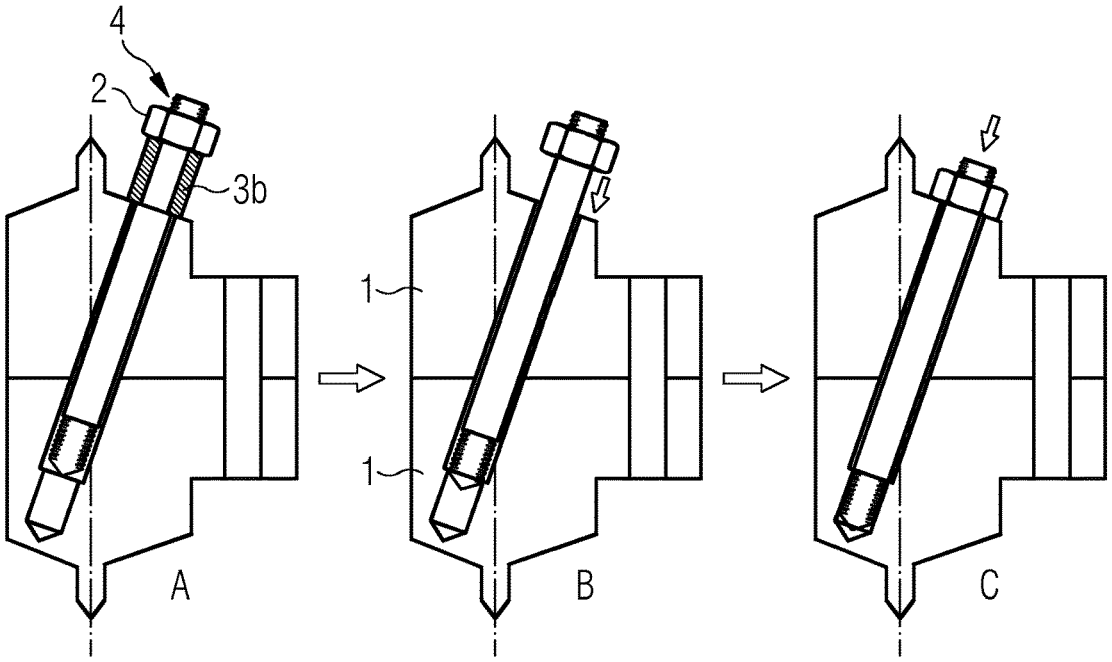
FIG. 7 shows the procedure of forming a flange connection with a stud system according to FIG. 6.

FIG. 7 shows the procedure of forming a flange connection with a stud system 4 according to FIG. 6.

In the left picture A, the flanges 1 are arranged upon another and the first spacer tube 3*a* is removed. The stud bolt glides down in the opening 1_thru, 1_part of the flange, but stops shortly before the thread of the blind opening 1_part due to the second spacer segment. Thus, the thread is not damaged by the impact of the movement of the stud bolt 2.

In the next picture B, the second spacer tube 3*b* is removed. Since the tip of the stud bolt 2 is not far from the thread of the blind opening 1_part, the stud bolt 2 touches the thread of the blind opening 1_part very smoothly without damaging the thread.

Now, in picture C, the stud bolt 2 can be screwed into the thread and the nut 2*b* can be fastened to connect the flanges 1 with each other.

Figure 8:
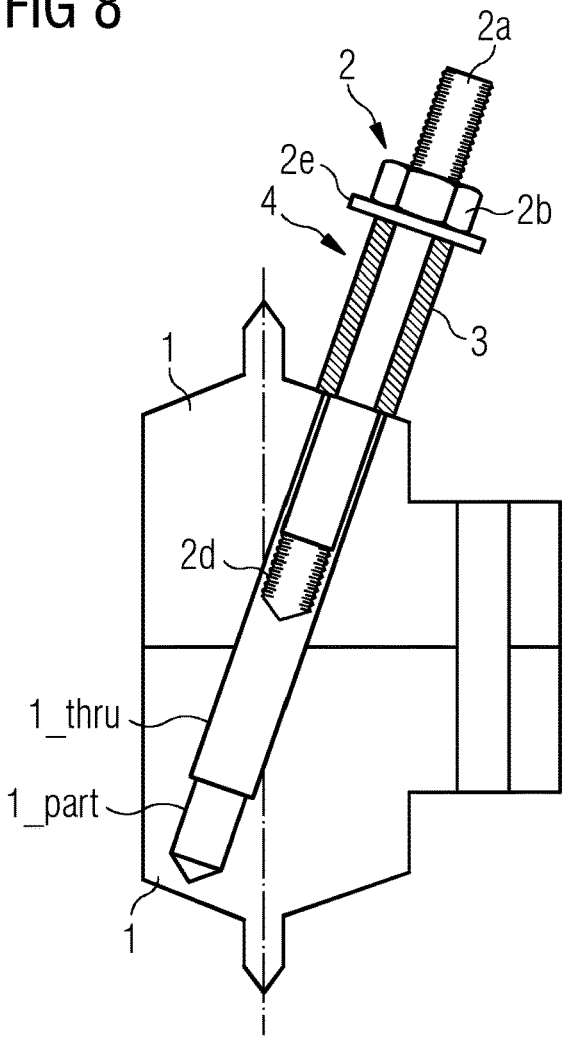
FIG. 8 shows a cross section of a flange connection with a preferred stud system according to the invention.

FIG. 8 shows a cross section of a flange connection with a stud system 4 according to embodiments of the invention. This stud system 4 is similar to the stud system shown in FIG. 4 with the difference that the nut 2*b* has been positioned nearer to the threaded end 2*d*. The head end 2*a* is threaded so that the nut 2*b* can be screwed up and down the head end 2*a.*

Figure 9:
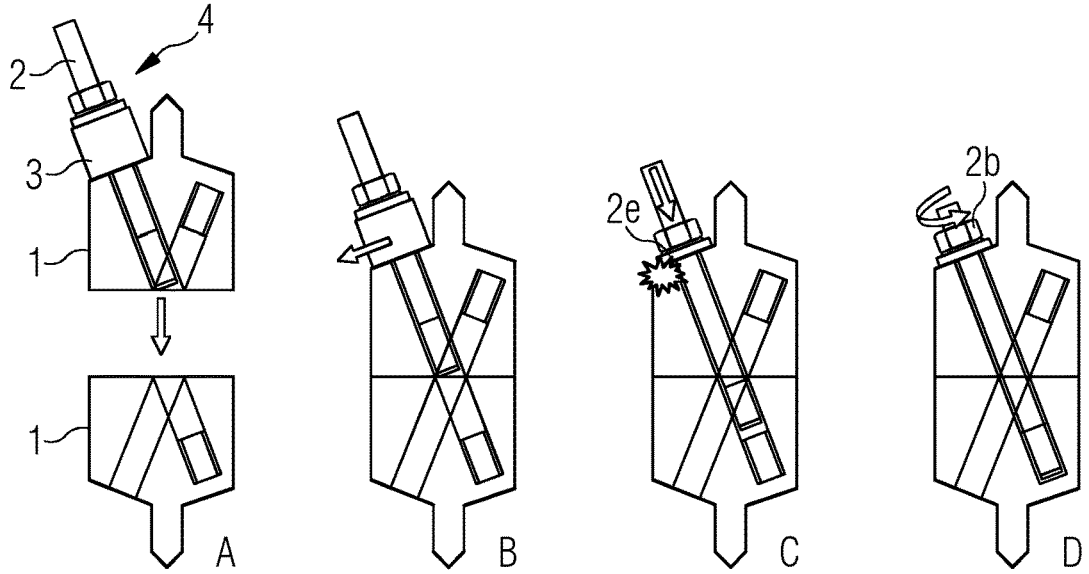
FIG. 9 shows the procedure of forming a flange connection with a stud system according to FIG. 8.

FIG. 9 shows the procedure of forming a flange connection with a stud system 4 according to FIG. 8.

In the left picture A, the flanges 1 are arranged upon another. Since the stud system 4 does not protrude from the bottom of the upper flange, an easy adjustment is possible.

In the next picture B, the spacer tube 3 is removed and the stud bolt glides down in the opening 1_thru, 1_part of the flange.

In the next picture C, the threaded end 2*d* of the stud bolt 2 does not hit the thread of the blind opening 1_part like in FIG. 5, but stops near the thread of the blind opening 1_part as in FIG. 7. The star at the washer indicates that the impact occurs there. A damage to the surface of the flange may be prevented by positioning the washer 2*e* under the spacer tube 3 (between spacer tube 3 and flange 1). Also a bolt extender 2*f* arranged as shown in FIG. 3 may prevent possible damage.

In picture D, the nut is unscrewed in the direction of the head end 2*a* so that the tip of the stud bolt 2 smoothly touches the thread of the blind opening 1_part. Now (after unscrewing the nut 2*b* a little bit more), the stud bolt 2 can be screwed into the thread and the nut 2*b* can be fastened to connect the flanges 1 with each other.

Figure 10:
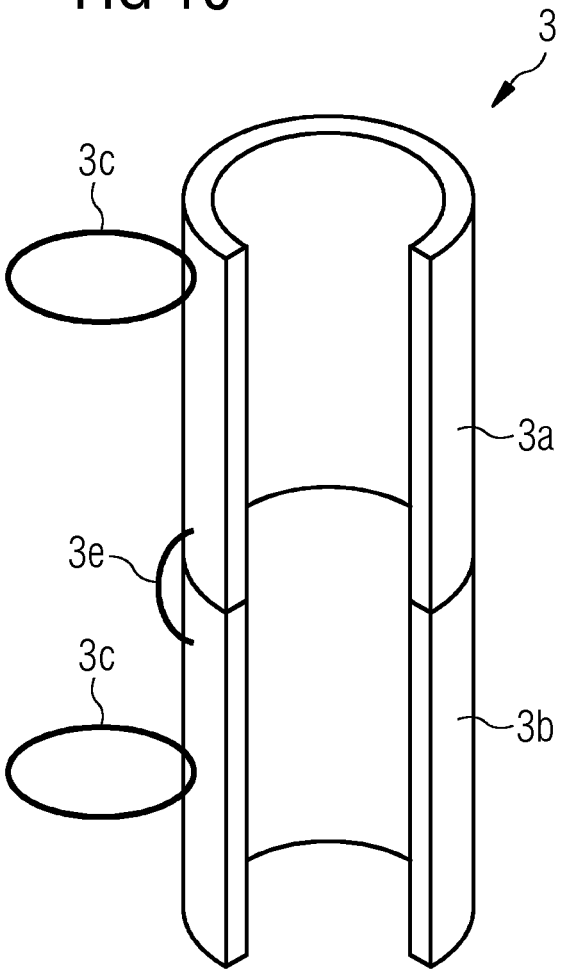
FIG. 10 shows a perspective view on a spacer tube comprising two spacer segments.

FIG. 10 shows a perspective view on a spacer tube 3 that is formed by two spacer segments 3*a*, 3*b,* a first spacer segment 3*a* and a second spacer segment 3*b,* that are arranged upon another. Here the first spacer segment 3*a* and the second spacer segment 3*b* are movably connected with each other by a connection string 3*e.* For removing the spacer segments 3*a,* 3*b,* each spacer segment 3*a,* 3*b* comprises a filament loop 3*c,* especially made of wire or string. Due to the special connection of the spacer segments 3*a,* 3*b,* after removing the first spacer segment 3*a,* it still clings to the second spacer segment 3*b*. The filament loops 3*c* are used to connect several spacer segments 3*a,* 3*b* with spacer segments 3*a,* 3*b* of different stud systems (see e.g., FIG. 3).

Figure 11:
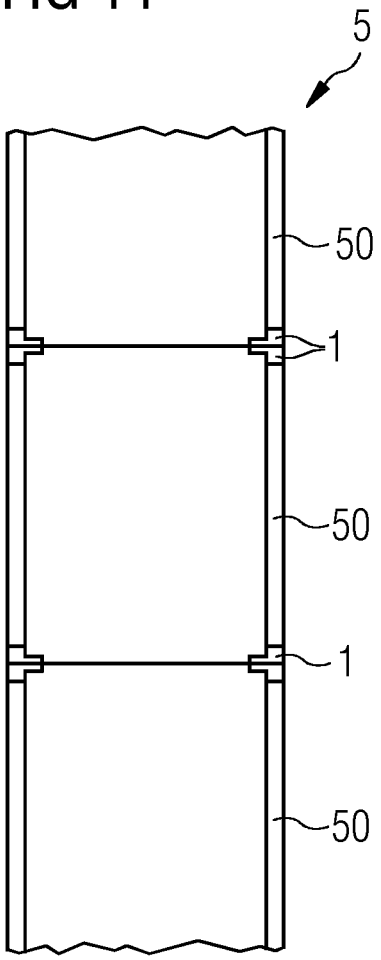
FIG. 11 shows a tower comprising stacked tower sections connected by flanges according to the invention.

FIG. 11 shows a tower 5, such as a wind turbine tower, comprising tower sections 50 "stacked" on top of each other and connected by flanges 1 according to embodiments of the invention. The flanges are outlined without further details. The way of equipping and fastening the flanges is described more accurately in the preceding figures.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A method of assembling a tower comprising tower sections, each equipped with a flange on each face, the flange comprising annular arrangements of threaded blind openings, the method comprising:

arranging a tower section on top of a further tower section so that annular arrangements of openings of the flange accord to each other to receive a set of fasteners for connecting the flange;

arranging a number of stud systems in a corresponding number of openings of the flange from above prior or after the arrangement of the tower segments;

removing of a number of spacer tubes laterally from the stud bolt of at least one arranged stud system so that the stud bolt is able to fall in the corresponding opening; and forming a permanent connection between the tower section and the further tower section by the stud bolts.

2. The method according to claim 1, wherein the number of stud systems are arranged in a corresponding number of openings of the flange, the method further comprising:

after removing of the number of spacer tubes, increasing the connecting length of the stud bolt by turning a nut along the threaded part of the head end until the connecting length is longer than the predefined opening-length plus the predefined non-threaded length.

3. The method according to claim 1, wherein the number of stud systems are arranged in a corresponding number of openings of a flange, the method further comprising:

after removing a first spacer segment from a stud bolt and falling of the stud bolt in the corresponding opening, removing a second spacer segment from the stud bolt to bring the stud bolt in connection with a thread of the opening.

4. The method according to claim 3, wherein the first spacer segment and the second spacer segment are movably connected with each other and the removing procedure of the first spacer segment is performed such that the removed first spacer segment still clings to the non-removed second spacer segment.

5. The method according to claim 1, wherein the openings of the flange are inclined relative to a vertical direction by at least 5° and less than 45°, and wherein the number of stud systems are arranged in a corresponding number of the openings of the flange from above.

6. The method according to claim 1, wherein the spacer tubes of the number of stud systems comprise connection loops, wherein the connection loops are connected with another by a connection element, wherein the spacer tubes are removed by moving the connection element such that the spacer tubes are laterally removed from the respective stud bolts, further wherein the connection element is flexible.

7. A tower comprising a plurality of essentially cylindrical tower sections equipped with flanges and permanently connected by stud bolts inserted through inclined openings of the flanges by the method according to claim 1.

* * * * *